US006535053B2

(12) United States Patent
Forsyth

(10) Patent No.: US 6,535,053 B2
(45) Date of Patent: Mar. 18, 2003

(54) METHOD FOR OBTAINING A TEMPERATURE—INDEPENDENT VOLTAGE REFERENCE AS WELL AS A CIRCUIT ARRANGEMENT FOR OBTAINING SUCH A VOLTAGE REFERENCE

(75) Inventor: Richard Forsyth, Graz (AT)

(73) Assignee: Austria Mikro Systeme International Aktiengesellschaft, Unterpremstäten (AT)

( * ) Notice: Subject to any disclaimer, the term of this patent is extended or adjusted under 35 U.S.C. 154(b) by 0 days.

(21) Appl. No.: 09/803,139

(22) Filed: Mar. 12, 2001

(65) Prior Publication Data

US 2001/0026188 A1 Oct. 4, 2001

(30) Foreign Application Priority Data

Mar. 10, 2000 (AT) ..... 404/00

(51) Int. Cl.[7] ..... G05F 3/02
(52) U.S. Cl. ..... 327/539; 327/542
(58) Field of Search ..... 323/312, 313, 323/314, 315; 324/132; 327/539, 542

(56) References Cited

U.S. PATENT DOCUMENTS 4,797,577 A 1/1989 Hing ..... 327/539
4,940,930 A * 7/1990 Detweiler ..... 323/273
5,453,682 A * 9/1995 Hinrichs et al. ..... 324/132
5,619,163 A 4/1997 Koo ..... 327/539
5,936,392 A 8/1999 Taylor ..... 323/315

* cited by examiner

*Primary Examiner*—Tuan T. Lam
*Assistant Examiner*—Hiep Nguyen
(74) *Attorney, Agent, or Firm*—Kevin E. Joyce

(57) ABSTRACT

In a method for obtaining a temperature-independent voltage reference by an energy gap reference circuit using at least one bipolar transistor and a voltage source, only a single bipolar transistor is connected in series with a resistor. Different voltages are facultatively applied to the resistor. The voltages are detected upstream and downstream of the series resistor and fed to an A/D converter. The gain constant of the A/D converter is calculated from the digitalized measurements and used for measurement correction. The circuit arrangement for obtaining such a temperature-independent voltage reference includes a bipolar transistor and a resistor connected in series with the transistor. An A/D converter configured to yield digitalized voltage measurements is connected via switches to ports provided on either side of the resistor. The digital signals from the A/D converter are fed to a computer to determine the gain constant, from which the corrected voltage signal can be read out digitally.

7 Claims, 1 Drawing Sheet

METHOD FOR OBTAINING A TEMPERATURE— INDEPENDENT VOLTAGE REFERENCE AS WELL AS A CIRCUIT ARRANGEMENT FOR OBTAINING SUCH A VOLTAGE REFERENCE

BACKGROUND OF THE INVENTION

1. Field of the Invention

The invention relates to a method for obtaining a temperature-independent voltage reference by means of an energy gap reference circuit using at least one bipolar transistor and a voltage source as well as a circuit arrangement for obtaining a temperature-independent voltage reference.

2. Prior Art

When using bipolar transistors as well as electronic components such as, for instance, analog-to-digital converters (A/D converters), known temperature dependences of the transistor parameters, or of the circuit, will have to be taken into account if a temperature-independent voltage reference is to be provided. In particular, the characteristic data of a bipolar transistor are strongly temperature-dependent, the temperature-dependent context between the collector current $I_C$ and the base emitter voltage $U_{BE}$ being of particular relevance. The dependence of $U_{BE}$ on the temperature T results from the following equation:

$$I_C = I_S e \frac{qU_{BE}}{kT} \tag{1}$$

The reason for such a temperature dependence of $I_C$ is the temperature dependence of the cutoff current $I_S$ and of the temperature voltage $$U_T = \frac{kT}{q},$$

wherein, taking into account the temperature dependence of the cutoff current $$I_S = Ae \frac{-qU_G}{kT} T^X, \tag{2}$$

the following relation applies:

$$I_C = Ae - \frac{U_G q}{kT} + \frac{U_{BE} q}{kT} T^X, \tag{3}$$

in which k is the Boltzmann constant ($1.38\times10^{-23}$ VAs/K), q is the elementary charge=$1.602\times10^{-19}$ As, $U_G\approx1.12$ V is the (band) gap voltage of silicon, T is the temperature, x is an empirical constant and A is a proportionality factor. In known circuit arrangements, the temperature dependence of $U_G$ is usually neglected.

With most bipolar transistors, an increase of $I_c$ to double its value results from the above relations at a temperature increase by 11° K. In circuits that serve to obtain voltage references, it has already been known to basically use as a voltage reference the base emitter voltage of a bipolar transistor. In such known analog circuits, a voltage having a symmetrically equal positive temperature coefficient is added in order to compensate for the known high temperature dependence, said voltage being generated in a second transistor. Therefore, the known gap voltage reference circuits used to obtain a voltage reference, as a rule, presuppose two transistors selected as to their characteristics, the selection having to be made with slight tolerances.

SUMMARY OF THE INVENTION

The invention aims to provide a method of the initially defined kind, which uses only a single bipolar transistor and, therefore, renders the selection of a second transistor tuned to the characteristics of the first transistor superfluous. Moreover, the invention aims to further reduce the temperature dependence of the measured values and to achieve a temperature compensation at a substantially higher accuracy. To solve this object, the method according to the invention essentially consists in that only a single bipolar transistor is connected in series with a resistor, that different voltages are facultatively applied, that the voltages are detected upstream and downstream of the series resistor and fed to an A/D converter and that the gain constant of the A/D converter is calculated from the digitalized measurements and used to correct the measurements. The fact that, within the context of the method according to the invention, an A/D converter is used in addition and the signals are subsequently processed in the digital form, additionally involves the temperature dependence of such ADC circuits, which must be compensated for. Within the context of the method according to the invention, the gain constant of the A/D converter, therefore, is determined from a plurality of measurenments for the respectively prevailing temperature and may each be updated accordingly such that actually corrected values will be available, which are characterized by a higher precision than is feasible with analog circuits.

According to a preferred realization of the method according to the invention, it is proceeded in a manner that, in order to correct the ADC gain constant, a value for the base emitter voltage of the bipolar transistor and a value for the cutoff current of the bipolar transistor are measured from the voltage drop on the resistor and that, by applying a computational technique, the temperature-dependent portions of the two measured values are eliminated and a gain constant applying for the respective temperature prevailing at the time of measurement is determined.

In order to determine the gain constant, it is proceeded within the context of the method according to the invention in a manner that the gain constant is calculated by $$S = \frac{-1 - \ln I_x + x + \ln A + x\ln\frac{q}{d\ln I_x k} + \ln R}{-1 + d\ln I_x U_G + x} \tag{13}$$

wherein $\ln I_x$ is the natural logarithm of the measurement for the collector current, x and A are constants, R is the resistance and $U_G$ is the (band) gap voltage (for Si≈1.12 V). Since the gain constant always is each newly calculated from a plurality of measurements by the algorithm explained in more detail below, it is feasible within the context of the method according to the invention and in correspondence with a preferred further development that the value for S is updated continuously or at regular time intervals and applied to calculate the actual reference voltage and, if desired, to precisely determine test voltages.

The circuit arrangement according to the invention used to obtain a temperature-independent reference voltage may be designed in a particularly simple manner, requiring but a small number of components. The circuit arrangement is essentially characterized in that it comprises, placed in series, a bipolar transistor and a resistor R connected with the transistor, that an A/D converter (ADC) configured to yield digitalized voltage measurements is connected via switches to ports provided on either side of the resistor R, and that the digital ADC signals are fed to a computer to determine the gain constant, from which the corrected voltage signal can be read out digitally.

The switch in a particularly simple manner may be designed as a multiplexer component whose inputs are switched by a control signal of the computer and comprise connectors or ports at which the voltages to be measured are applied by actuation of the associated switch. The multiplexer, thus, transmits the analog signals to the analog input of the ADC as a function of the switch position. In principle, the circuit arrangement may be established using PNP or NPN transistors. In the case of PNP transistors, the emitter is connected with the resistor and the collector that is coupled with the base is connected to ground, the adjustable voltage source being connected to the other port of the resistor.

A preferred use of the circuit arrangement according to the invention is the use in a digital voltmeter, the principal mode of operation as well as the circuit arrangement being in no way limited to such digital voltmeters.

In the following, the invention will be explained in more detail by way of the computational algorithm chosen for the calculation of the gain constant and by way of an exemplary circuit used with a digital voltmeter.

Departing from the basic relationship reflecting the dependence of $U_{BE}$ on the temperature T in a bipolar transistor $$I_C = I_S e^{\frac{qU_{BE}}{kT}}, \tag{1}$$

it is then further considered that not only the collector current but also the cutoff current $I_S$ is temperature-dependent. The temperature dependence of the cutoff current follows the relation $$I_S = Ae^{\frac{-qU_G}{kT}} T^x, \tag{2}$$

the meanings indicated above also applying in the instant relations.

By inserting the meaning $I_S$ according to equation (2) in the equation (1), the relation $$I_C = Ae^{\frac{-U_G q}{kT} + \frac{U_{BE} q}{kT}} T^x \tag{3}$$

will be obtained.

When using an A/D converter, a temperature-dependent gain S is imparted on the analog measurements in the ADC, which would cause respective errors if no temperature compensation were effected. For the computational elimination of such errors, $U_{BE}$ is at first replaced with $U_x$, from which results the relation $$U_{BE} = \frac{U_x}{S}$$

with $U_x$ indicating the measured voltage that is to be corrected by applying the correct gain constant. In the same manner, $I_c$ may be replaced with the actual value $I_x$, which is measured as a voltage drop on the resistor R and must have the same gain constant S. Appropriate substitution yields the relation $$I_C = \frac{e\ln I_x}{RS}, \tag{4}$$

whereby the natural logarithm of this current measurment is subsequently expressed according to the relation $$\ln I_x = \ln\left[Ae^{\frac{-U_G q}{kT} + \frac{U_x q}{kT}} RST^x\right]. \tag{5}$$

By this relation, the graphic representation of the dependence of $I_x$ and $U_x$, thus, becomes feasible, $\ln I_x$ being plotted on the Y-axis and $U_x$ being plotted on the X-axis. There will be obtained a straight line with the slope $d\ln I_x$, which intersects the Y-axis in point $U_x=0$ at the respective value of $d\ln I_x$. Thus, the slope of this straight line is $$d\ln I_x = \frac{q}{kST}. \tag{6}$$

By solving this relation for T, $$T = \frac{q}{d\ln I_x kS} \tag{7}$$

is obtained.

At the point $U_x=0$, upon insertion in $$\ln I_x = \ln\left[Ae^{\frac{-U_G q}{kT} + \frac{U_x q}{kT}} RST^x\right], \tag{5}$$

the relation $$\ln I_x = \ln\left[Ae^{\frac{-U_G q}{kT}} RST^x\right] \tag{8}$$

may then be derived. By the appropriate transformation of this equation, the relations $$\ln I_x = \frac{-U_G q}{kT} + \ln A + \ln R + \ln S + x\ln T \tag{9}$$

and, furthermore, $$\ln I_x = -d\ln I_x U_G S + \ln A + \ln R + x\ln\frac{q}{d\ln I_x ks} + \ln S \tag{10}$$

and, finally, $$\ln I_x = -d\ln I_x U_G S + \ln A + x\ln\frac{q}{d\ln I_x k} + \ln R + \ln S - x\ln S. \tag{11}$$

are obtained.

From this relation, it is clearly apparent that the absolute temperature T does no longer appear in the determination of the true value of the gain constant S, said relation merely containing universal constants $U_G$, q, k as well as the known values as well as temperature-independent expressions x, A and the value R which is only slightly temperature-dependent. If, in addition, the temperature dependence of R is to be taken into account, this may, for instance, be effected by a suitable modification of the value X.

In order to solve this equation, a Taylor expansion of the first order may be effected for in S by the value 1.0, from which results $$\ln I_x = -1 + S + d\ln I_x U_G S - (-1 + S)x + \ln A + x\ln\frac{q}{d\ln I_x k} + \ln R. \quad (12)$$

From the solution of this equation follows $$s = \frac{-1 - \ln I_x + x + \ln A + x\ln\frac{q}{d\ln I_x k} + \ln R}{-1 + d\ln I_x U_G + x}. \quad (13)$$

Overall, x, A and R may be calibrated individually for every circuit arrangement, particularly suitable values being precalculatable by simulation.

In a continuous self-calibrating system, the value for the gain constant S may each be updated continuously or at regular time intervals such that precise values will always be obtained iteratively. On grounds of such an iteration procedure, it is also readily permissible to insert only one Taylor expansion of the first order in the above calculation.

Without any particular calibration, an accuracy of about 1% may be reached by such calculations. If the values for x, A and R are suitably optimized, the accuracy may even be enhanced to below 0.1% at an operating temperature range of about 100° K.

BRIEF DESCRIPTION OF THE DRAWING

In the following, the invention will be explained in more detail by way of an exemplary embodiment of a digital voltmeter illustrated in the drawing.

DETAILED DESCRIPTION OF A PREFERRED EMBODIMENT

Figure 1:
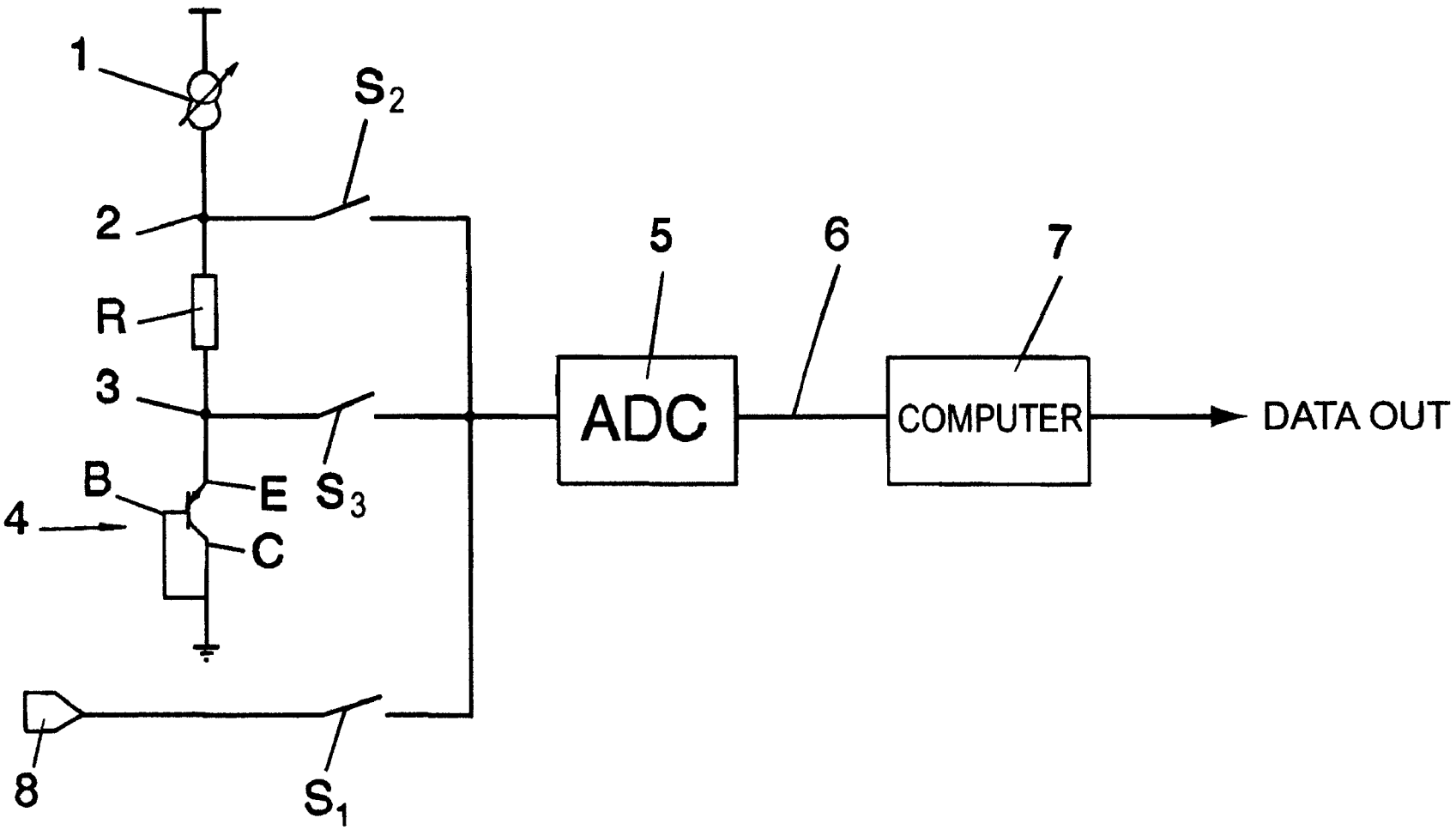

In the drawing, 1 serves to denote a variable voltage source by which different voltages may be generated. The voltage is applied to connector or port 2 of a resistor R, whereby, in the circuit arrangement illustrated, a PNP transistor whose emitter E is coupled to port 3 of the resistor is used. The base and the collector of the bipolar transistor 4 are again connected to ground or zero potential, whereby the respective voltage values capable of being detected at 2 and 3 are alternatively fed to the A/D converter as analog signals via switches $S_2$ and $S_3$. The signal digitalized in the ADC 5, via a signal line 6, reaches a computer 7 in which the appropriate corrections are made in correspondence with the computational algorithm mentioned above. For use as a digital voltmeter, an additional switch $S_1$ is provided, via which a test voltage may be applied to the ADC 5 via a terminal 8 and measured.

The switches $S_1$, $S_2$ and $S_3$ are each alternatively closed, whereby said switches $S_1$, $S_2$ and $S_3$ may be contained in a multiplexer and the switch positions themselves may be controlled by the computer 7. In principle, the voltages at ports 2 and 3 must be determined and subtracted from each other in order to establish the measured value $V_x = I_X \cdot R$, the quantity $V_x$ being determinable via athe switch $S_3$ with the switches $S_1$ and $S_2$ opened. Since the voltage source 1 is adjustable to different voltages, different measuring points may be provided for the evaluation indicated above, from which measuring points the respectively current value for S may be calculated.

In the main, a digital reference voltage technique that allows for the continuous recalibration of the ADC is, thus, applied, whereby not only temperature effects but also other effects depending on the operating time can be largely compensated for by the appropriate frequency of such calibrations.

What I claim is:

1. A method for obtaining a temperature-independent voltage reference in an energy gap reference circuit arrangement using at least one bipolar transistor and voltage source, which method comprises the steps of:

providing a resistor and connecting only a single bipolar transistor in series with said resistor, facultatively applying different voltages to said resistor, measuring said different voltages upstream and downstream of said resistor so as to obtain a plurality of measured voltages, providing an A/D converter and feeding said plurality of measured voltages to said A/D converter so as to obtain a plurality of digitalized voltage measurements, applying said plurality of digitalized voltage measurements to a computer for calculating the gain constant of said A/D converter, said gain constant being a value S, wherein $$s = \frac{-1 - \ln I_x + x + \ln A + x\ln\frac{q}{d\ln I_x k} + \ln R}{-1 + d\ln I_x U_G + x}$$

where $\ln I_x$ is the natural logarithm of the collector current measurement, x, q and A are constants, R is the resistance value and $U_G$ is the gap voltage of the bipolar transistor, and using said gain constant for computer generating corrected voltage signal data which is read out of the computer.

2. A method as set forth in claim 1, further comprising:

measuring a base emitter voltage value of said bipolar transistor and a cutoff current value of said bipolar transistor from the voltage drop on said resistor, for correction of said gain constant of said A/D converter, eliminating the temperature-dependent portions of said base emitter voltage value and said cutoff current value by applying a computational technique, and determining in said computer a gain constant of the A/D converter valid for a respective temperature prevailing at the time of measuring.

3. A method as set forth in claim 1, wherein said value S is continuously updated by said computer and used for calculating the actual reference voltage.

4. A method as set forth in claim 1, wherein said value S is updated by said computer at regular time intervals and used for calculating the actual reference voltage.

5. A method as set forth in claim 3, wherein said value S is used for calculating the value of test voltages applied to said A/D converter.

6. A method as set forth in claim 4, wherein said value S is used for calculating the value of test voltages applied to said A/D converter.

7. An energy gap reference circuit arrangement for obtaining a temperature-independent voltage reference, comprising:

a single bipolar transistor, a resistor to which different voltages are applied, said resistor being connected in series with said bipolar resistor, port means provided on either side of said resistor for respective voltage measurements;

an A/D converter, switch means configured to connect said A/D converter to said port means, said A/D converter being configured to receive said respective voltage measurements from said port means, transform said respective voltage measurements into digitalized voltage measurements and generate digital signals representing said digitalized voltage measurements; and a computer configured to: (a) receive said digital signals from said A/D converter; (b) calculate a gain constant S of said A/D converter for correction of said digital signals wherein $$s = \frac{-1 - \ln I_x + x + \ln A + x\ln\frac{q}{d\ln I_x k} + \ln R}{-1 + d\ln I_x U_G + x}$$

where $\ln I_x$ is the natural logarithm of the collector current measurement, x, q and A are constants, R is the resistance value and $U_G$ is the gap voltage of the bipolar transistor; and (c) enable said digital signals, upon correction, to be read out as data from said computer.

* * * * *